United States Patent [19]

Lindquist

[11] 4,130,283

[45] Dec. 19, 1978

[54] SIMULATED FAIRWAY SURFACE FOR GOLF APPARATUS

[75] Inventor: Everet F. Lindquist, Iowa City, Iowa

[73] Assignee: University of Iowa Research Foundation, Iowa City, Iowa

[21] Appl. No.: 757,238

[22] Filed: Jan. 6, 1977

[51] Int. Cl.[2] ..... A63B 69/36

[52] U.S. Cl. ..... 273/195 A; 273/186 R; 273/186 C

[58] Field of Search ..... 273/195 R, 195 A, 195 B, 273/200 B, 176 H, 176 J, 186 R, 186 C, 195, 186

[56] References Cited

U.S. PATENT DOCUMENTS

| | | | |
|---|---|---|---|
| 3,345,073 | 10/1967 | Hoffman | 273/200 B X |
| 3,423,096 | 1/1969 | Tone | 273/195 A |
| 3,639,923 | 2/1972 | Stewart | 273/195 A X |
| 3,712,628 | 1/1973 | Boss | 273/195 A X |
| 3,870,314 | 3/1975 | Bertucci | 273/195 R X |

*Primary Examiner*—George J. Marlo
*Attorney, Agent, or Firm*—James C. Nemmers

[57] ABSTRACT

A device for use in connection with a golf game or practice apparatus for simulating a fairway surface to enable a player to execute each shot as he would in actual play, especially enabling the player to "strike down" at the golf ball with the simulated feel of taking a chunk of turf but without damaging the simulated fairway surface. The device utilizes an artificial grass turf secured to a cushioned support that is movable in the direction of flight of the ball and compressible when the surface is struck during the golfer's swing. The movable and compressible portion of the artificial turf will return to its original position as soon as the club head is disengaged from the turf. The movable section of artificial turf together with the cushioned support thus provides the golfer with the same "feel" as if actual turf had been taken during the golf shot.

4 Claims, 3 Drawing Figures

SIMULATED FAIRWAY SURFACE FOR GOLF APPARATUS

BACKGROUND OF THE INVENTION

In recent years, the game of golf has attracted millions of golfers throughout the United States and has gained popularity in many foreign countries. The vast majority of these golfers are leisure-time golfers who play the game with insufficient frequency to rapidly improve their scores. However, even the leisure-time golfers consider the game a highly competitive sport and are always looking for ways to easily lower their scores. Improvement generally requires many hours of practice, and few golfers have access to good practice facilities. Practice on a golf course itself is virtually an impossibility because of the crowded conditions of most courses and because of the limited amount of time the average leisure-time golfer has to devote to improving his golf game.

When the foregoing difficulties are coupled with the relatively short outdoor playing season that exists throughout most of the United States, there is a need for any means that will assist the golfer in improving his game through practice. There are available for practice a number of outdoor driving ranges, and indoor practice facilities are becoming increasingly available. Many of the indoor facilities use inexpensive devices and apparatus which in many instances have done little to improve the golfer's game. Also, many prior art devices and apparatus are not satisfactory because they do not simulate sufficient realism so as to enable the golfer to obtain the maximum value from his practice sessions.

Prior art devices and apparatus which are used for indoor golf practice or for "play", allow a golfer to some degree to practice his swing with woods since such facilities normally provide tees to elevate the ball above the artificial surface. However, the prior art devices which are used in indoor facilities require the player to place the ball on a simulated turf, such as a strip of nylon pile carpet, an inverted brush, or a strip of one of the many artificial "grasses", when the player wishes to practice iron shots. If, with this type of simulated turf, the player accidentally strikes the surface behind the ball before the ball is struck, or if the player intentionally "strikes down" at the ball as he might frequently do in actual play to produce greater back spin on the ball, the player is likely either to damage the surface or his elbow, or both. To avoid such damage, the player, therefore, must "scoop" or "sweep" the ball off the artificial simulated turf and thus practice an improper way of executing the golf shot.

There is, therefore, a need for a device which will simulate the fairway surface and thereby enable the golfer to "strike down" at the ball and obtain the "feel" of "taking a chunk of turf" but without damaging the surface. Such a device would be useful in all types of indoor, and even outdoor, practice facilities. One such facility with which the device of the invention can be effectively used is the apparatus shown in my co-pending U.S. patent application Ser. No. 752,022, filed Dec. 20, 1976, for a "Golf Game and Practice Apparatus".

SUMMARY OF THE INVENTION

The device of the invention consists essentially of artificial grass turf of any suitable type commercially available. A movable section of artificial turf is supported on a cushion which in turn is mounted on a movable frame member that is surrounded by similar cushioned artificial turf. The movable frame member is positioned on guides which allow the movable member to move in the direction of the flight of the ball to be struck. The forward movement of the movable member is limited by resilient means which also functions to return the movable member to its original position. Thus, with the golf ball placed on the movable member, a golfer can "strike down" at the ball with the result that a golf club will simply depress the artificial turf into the supporting cushion and push the movable member forward until the club disengages from the turf at which time the resilient member will return the movable member to its original position. A device of the invention thus simulates the actual feel of a fairway golf shot.

DESCRIPTION OF THE PREFERRED EMBODIMENT OF THE INVENTION

The device of the invention is useable in a number of different applications, one such application being for use in a golf game or a golf practice apparatus. The device of the invention for example can be used in the golf game and practice apparatus described and claimed in co-pending U.S. patent application Ser. No. 752,022, referred to above. When used in apparatus of this type, the device of the present invention is preferably built into the proper position in the player's station of the apparatus such that the top surface of the artificial turf of the device is level with the top surface of the player's station. The device shown in FIG. 1 is shown separate and independent from any apparatus, but the device of the preferred embodiment of this invention is designed for use in the apparatus shown and described in said co-pending U.S. patent application.

Figure 1:
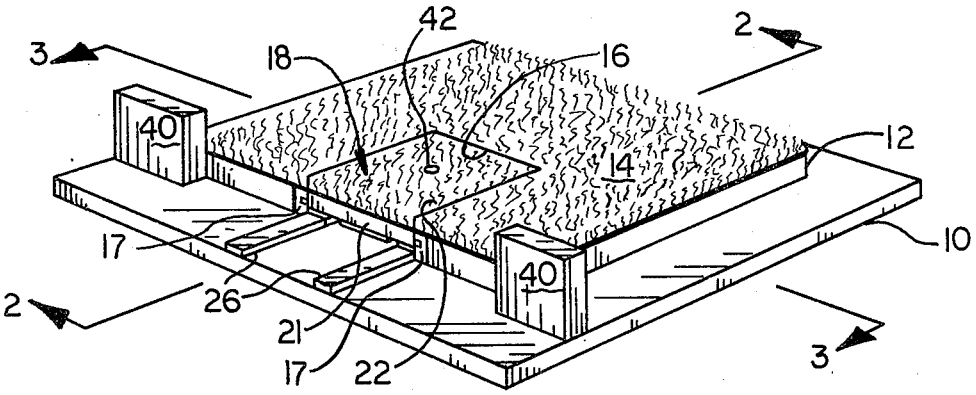
FIG. 1 is a perspective view of a device constructed according to the principles of the invention.

Referring now to FIG. 1, the device of the invention has a supporting base 10 of any suitable rigid material. Affixed to the base 10 is a layer 12 of a relatively thick cushioned material such as foam rubber. Resting directly on top of and affixed to the cushioned layer 12 is a layer 14 of artificial "turf" which may be any one of the commercially available artificial turfs that are made of tough plastic. A number of such turfs are available with "blades of grass" of varying degrees of thickness and toughness. A turf should be selected that will simulate actual grass as nearly as possible or simulate a "sand" shot as explained hereinafter. As used hereinafter and in the claims, "turf" and "turf means" refers to any artificial surface used to simulate a golf shot from the fairway, rough, sand, etc. In the forward center section of the device of the invention, there is a rectangular cut-out portion 16 surrounded on three sides by a supporting frame 17. There is positioned in cut-out portion 16 a movable member 18 which is referred to hereinafter as the "sled 18".

Sled 18 has a cushioned layer 20 (made of the same material as the cushioned layer 12) surrounded on three sides by a supporting frame 21. Affixed to the upper surface of the cushioned layer 20 and to supporting frame 21 is a layer of flexible artificial turf 22. The artificial turf 22 may be of the same material as the artificial turf 14, or since the sled 18 is removable and can, therefore, easily be replaced, the artificial turf 22 may be different from the artificial turf 14. For example, a layer of flexible (short) bristle faced material may be substituted for the normal turf so as to simulate somewhat a sand surface. With stiff bristles about ½ inch or ¼ inch long selected so as to provide the desired resistance, if the lower edge of the player's club passes just below the ball, the "feel" may be the same as a sand shot. If he strikes the bristles too far behind the ball, the result will be a "muffed" shot.

Affixed to the lower surface of the frame 21 supporting the cushioned layer 20 of sled 18 are a pair of slides 24 which are constructed of a low friction material such as Teflon. Within the cut-out portion 16 and affixed to the base 10 are a pair of corresponding rails 26 also made of the same or other suitable low friction material. Rails 26 are spaced apart and positioned so as to engage the corresponding slides 24 on the sled 18.

Figure 3:
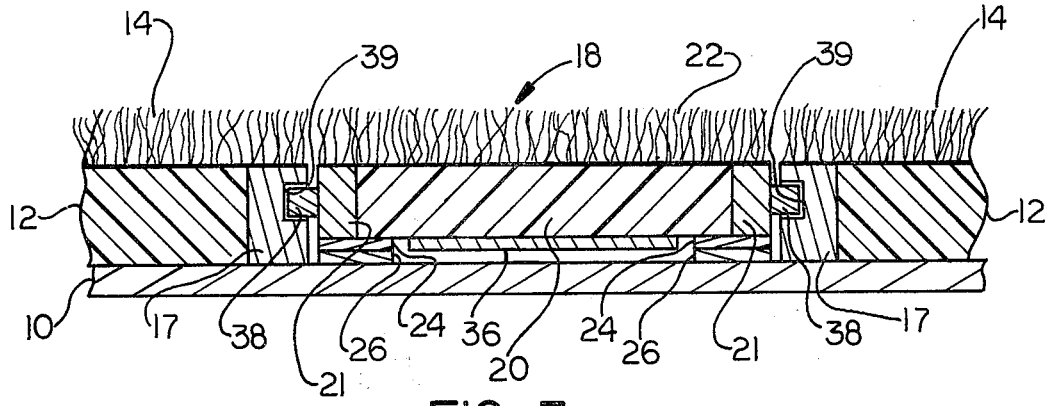
FIG. 3 is a sectional view of the device taken on the line 3—3 of FIG. 1.
Figure 2:
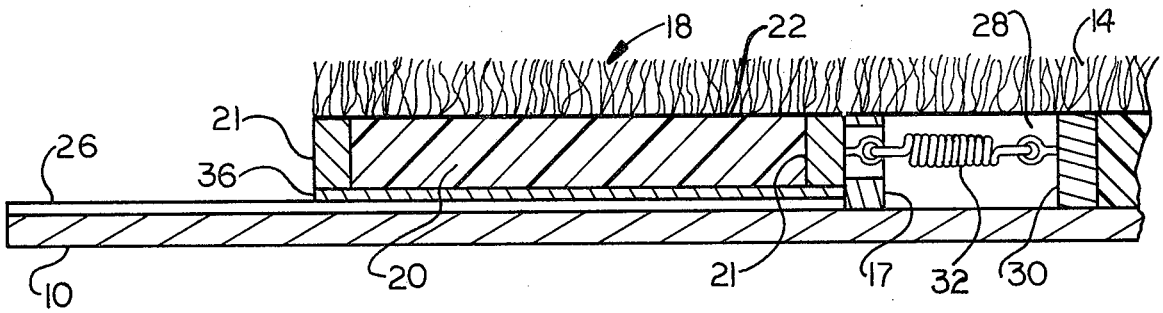
FIG. 2 is a sectional view of the device taken on the line 2—2 of FIG. 1.

As best seen in FIG. 2, the cushioned layer 12 of base 10 is cutout to the rear of cut-out portion 16 and frame 17 to form an open area 28 beneath the turf layer 14. At the rear of the open area 28 is a supporting block 30 preferably of rigid, relatively strong material. Supporting block 30 provides for the attachment of a resilient member 32, such as a rubber band or spring, the other end of which is affixed to the frame 21 of sled 18. Of course, a large hole is provided in the rear member of frame 17 at the rear of cut-out portion 16 to permit the resilient member 32 to extend from area 28 to sled 18.

If desired, the lower surface of the central portion of sled 18 can also be provided with a thin sheet 36 made of a low friction material, which sheet 36 slides easily over the base 10 when the sled 18 is pressed downwards by the golf club. Also, if desired, the sides of frame 21 of sled 18 may be provided with strips 38 of low friction material to form tongues which slide in corresponding fixed grooves 39 in frame 17. This provides for free forward and backward movement of the sled 18 without allowing it to accidentally come out of position when pulled back by the resilient members 32.

There is also shown in FIG. 1 housings 40 on each side of the sled 18, which housings 40 may be used to house suitable sensors and a light source when the device of the invention is used with an apparatus similar to that of my invention described in co-pending U.S. patent application Ser. No. 752,022.

It should be understood that when the device of the invention is placed in use, the upper surface of the artificial turf 14 would be level with surrounding "turf" or floor on which the player stands. Also, the sled 18 is easily removable from the device by simply disconnecting the resilient member 32 so that the sled can be replaced if the artificial turf 22 on the sled becomes worn through use. Also, this permits the easy replacement of a sled containing an artificial turf of a differenct texture so as to simulate different fairway conditions and, therefore, allow the golfer to select the artificial turf which gives him the desired "feel" for his golf shot.

Also, if desired, the sled 18 can be provided with a suitable vertically extending opening 42 (FIG. 1) in its upper surface, which opening can be used for insertion of a tee, thereby allowing the golfer to also practice his wood shots.

Although the use of the device of the invention should be obvious from the foregoing description, its use and function will be briefly summarized. With the device in place so that the upper surface of the artificial turf 14 is level with the surrounding surface of the player's station, a golfer who desires to practice a fairway shot would place the ball near the center of the front half of the sled 18 with the ball resting on the artificial turf 22. The golfer would then take his stance over the ball and take his usual, normal golf shot. When the player "strikes down" at the ball, the golf club will simply depress the artificial turf 22 into the cushioned layer 20 and simultaneously push the sled 18 forward. When the golf club reaches the point in its arc when it would normally be "emerging from the turf", the golf club will be disengaged from the artificial turf 22 and the sled 18 thereby released. The resilient member 32 will, therefore, return the sled 18 to its original position, guided and restricted by the tongues 38 in grooves 39.

The resiliency of the cushioned layer 20 and the strength of the resilient member 32 should be selected so that the golf club meets approximately the same resistance as if it were actually "taking turf" with the result that the golfer has much the same "feel" as if actual turf had been taken.

Having thus described a preferred embodiment of the invention, it will be obvious to those skilled in the art that various revisions and modifications can be made to the embodiment shown herein without departing from the spirit and scope of the invention. It is my intention, however, that all such revisions and modifications as are obvious to those skilled in the art will be included within the scope of the following claims.

I claim:

1. A device for simulating actual fairway turf so as to provide for proper execution of a golf shot when a golf ball resting on said device is struck by a golf club, said device comprising a supporting base, artificial turf means having front, rear and side margins supported by and slidably movable relative to said base in a generally horizontal plane, said turf means having a layer of resilient material extending between said front, rear and side margins so as to provide a cushioned layer, said turf means also having an artificial turf layer on top of said cushioned layer, guide members extending from the side margins of said artificial turf means transversely to the direction of movement thereof, the portions of the supporting base adjacent the side margins of said artificial turf means including grooves corresponding to said guide members and in which said guide members are engaged, said guide members and grooves providing guide means to limit movement of said turf means forwardly and rearwardly primarily in a horizontal plane from an initial at-rest position in the direction of flight of a golf ball when struck by a golf club, and resilient means combined with said turf means to return said turf means to said initial position when said turf means is moved forwardly during a golf shot.

2. The device of claim 1 in which said resilient means is an elongated resilient member having one end affixed to said artificial turf means at its rear margin and the other end affixed to said base rearwardly of said artificial turf means.

3. A device for simulating actual fairway turf so as to provide for proper execution of a golf shot when a golf ball resting on said device is struck by a golf club, said device comprising a supporting base, artificial turf means having front, rear and side margins supported by and slidably movable relative to said base along a path generally in a horizontal plane, said artificial turf means and said base having corresponding tongue and groove portions slidably engagable with each other to guide said turf means and limit its movement relative to said base along said path from an initial at-rest position forwardly primarily in the direction of flight of a golf ball when struck by a golf club, said turf means having a layer of resilient material extending between said front, rear and side margins so as to provide a cushioned layer, said turf means also having an artificial turf layer on top of said cushioned layer, and resilient means combined with said turf means to return said turf means to said initial position when said turf means is moved forwardly during a golf shot.

4. The device of claim 3 in which said artificial turf means includes means to reduce the friction between said turf means and said base when said turf means move slidably relative to said base.

* * * * *